US007993468B2

(12) United States Patent
Staten

(10) Patent No.: US 7,993,468 B2
(45) Date of Patent: Aug. 9, 2011

(54) ADAPTIVE SANITATION SYSTEM

(75) Inventor: Richard C. Staten, Woodstock, GA (US)

(73) Assignee: The Coca-Cola Company, Atlanta, GA (US)

( * ) Notice: Subject to any disclaimer, the term of this patent is extended or adjusted under 35 U.S.C. 154(b) by 1746 days.

(21) Appl. No.: 11/160,047

(22) Filed: Jun. 7, 2005

(65) Prior Publication Data

US 2006/0273120 A1 Dec. 7, 2006

(51) Int. Cl.
*B08B 7/04* (2006.01)

(52) U.S. Cl. ... 134/18; 134/22.1; 134/22.11; 134/22.18; 62/303; 222/148; 222/651

(58) Field of Classification Search ..... None
See application file for complete search history.

(56) References Cited

U.S. PATENT DOCUMENTS

| | | | | |
|---|---|---|---|---|
| 4,848,381 | A | 7/1989 | Livingston et al. | |
| 6,625,993 | B2 | 9/2003 | Frank et al. | 62/68 |
| 2002/0127158 | A1* | 9/2002 | Holsclaw et al. | 422/186.07 |
| 2003/0182732 | A1* | 10/2003 | Davenet et al. | 8/158 |

FOREIGN PATENT DOCUMENTS

| | | | |
|---|---|---|---|
| EP | 0983962 | A1 | 3/2000 |
| WO | 2005047170 | A1 | 5/2005 |
| WO | 2006066338 | A1 | 6/2006 |
| WO | 2004058019 | A1 | 12/2006 |

* cited by examiner

*Primary Examiner* — Michael Barr
*Assistant Examiner* — Eric Golightly
(74) *Attorney, Agent, or Firm* — Sutherland Asbill & Brennan LLP

(57) ABSTRACT

A method for altering an initiation time of an apparatus sanitation cycle based upon a base line flow rate. The method may include determining an actual flow rate through the apparatus, comparing the actual flow rate to the base line flow rate, and delaying the initiation time of the apparatus sanitation cycle if the actual flow rate exceeds the base line flow rate.

17 Claims, 1 Drawing Sheet

ADAPTIVE SANITATION SYSTEM

TECHNICAL FIELD

The present invention relates generally to a dispensing apparatus and more particularly relates to beverage dispensers or others types of devices that initiate a sanitation cycle based upon several predetermined factors.

BACKGROUND OF THE INVENTION

Dispensing machines, such as those for beverages and confections, generally have product delivery systems that should be sanitized on a regular basis. Specifically, the machine may need to be sanitized on a daily, weekly, monthly, and/or semi-annually basis. For example, certain low acid beverages, such a frozen beverages, may have a pH level that may permit microorganism growth over a certain amount of time even given the cold temperatures involved. Laboratory testing may determine the growth parameters for a given product so as to determine a relevant time frame. The sanitation cycles generally are set on this determined time frame plus a margin of safety. Thus, most known equipment is sanitized on a straight time interval basis.

This time-based approach, while effective, generally does not compensate for varying product demand levels in a given location. Higher demand and usage levels generally require less sanitation due to the inverse ratio between product dwell time and product demand rate. In other words, because the product is in the dispenser for less time, there is less opportunity for microorganism growth.

Further, this time-based approach generally does not compensate for unscheduled shutdowns. A beverage dispenser generally must be sanitized immediately following any type of unscheduled shutdown. Known beverage dispensers, however, may not compensate for, or take into account, the additional sanitation cycle before initiating a regularly scheduled cycle.

What is desired, therefore, is a dispenser that takes into account other factors beyond the time between sanitation cycles. Preferably, the system can be adaptive to the nature of the product, demand levels, equipment functionality, time intervals, or other factors.

SUMMARY OF THE INVENTION

The present application thus describes a method for altering an initiation time of an apparatus sanitation cycle based upon a base line flow rate. The method may include determining an actual flow rate through the apparatus, comparing the actual flow rate to the base line flow rate, and delaying the initiation time of the apparatus sanitation cycle if the actual flow rate exceeds the base line flow rate.

The delaying step may include delaying the initiation time of the apparatus sanitation cycle if the actual flow rate exceeds the base line flow rate by a predetermined volume. The delaying step also may include initiating the apparatus sanitation cycle at a predetermined time if the actual flow rate does not exceed the base line flow rate by a predetermined volume. The method further may include initiating the apparatus sanitation cycle at a predetermined time if the actual flow rate does not exceed the base line flow rate.

The apparatus sanitation cycle may include defrosting the apparatus, cleaning the apparatus, rinsing the apparatus, sanitizing the apparatus, and/or refilling the apparatus. The comparing step may include determining a type of product loaded in the apparatus and looking up data on the type of product.

The method further may include initiating the apparatus sanitation cycle if a not to exceed date is reached.

The present application further may describe a dispenser. The dispenser may include a source of product, a flow meter to determine the volume of the product flowing through the dispenser, a sanitation system, and a controller. The controller may activate the sanitation system based upon the volume of product flowing through the dispenser as measured by the flow meter.

The flow meter may include a paddlewheel. The source of product may include concentrate and water and the flow meter may determine the volume of the concentrate and the water flowing through the dispenser. The dispenser further may include a freezing chamber.

The controller may include data on the source of product. The controller may compare the volume of product flowing through the dispenser to a base line flow rate. The controller may activate the sanitation system at a predetermined time if the volume of product flowing through the dispenser does not exceed the base line flow rate. The controller also may activate the sanitation system when a not to exceed date is reached.

The source of product may include a radio frequency identification tag. The radio frequency identification tag may include data on a product therein.

A further method described herein provides for activating an apparatus sanitation cycle. The method may include determining an actual flow rate through the apparatus over a predetermined period, comparing the actual flow rate to a base line flow rate over the predetermined period for a given product, and activating the sanitation cycle if the actual flow rate is less than the base line flow rate.

These and other features of the present invention will become apparent upon review of the following detailed description when taken in conjunction with the drawings and the appended claims.

DETAILED DESCRIPTION

Figure 1:
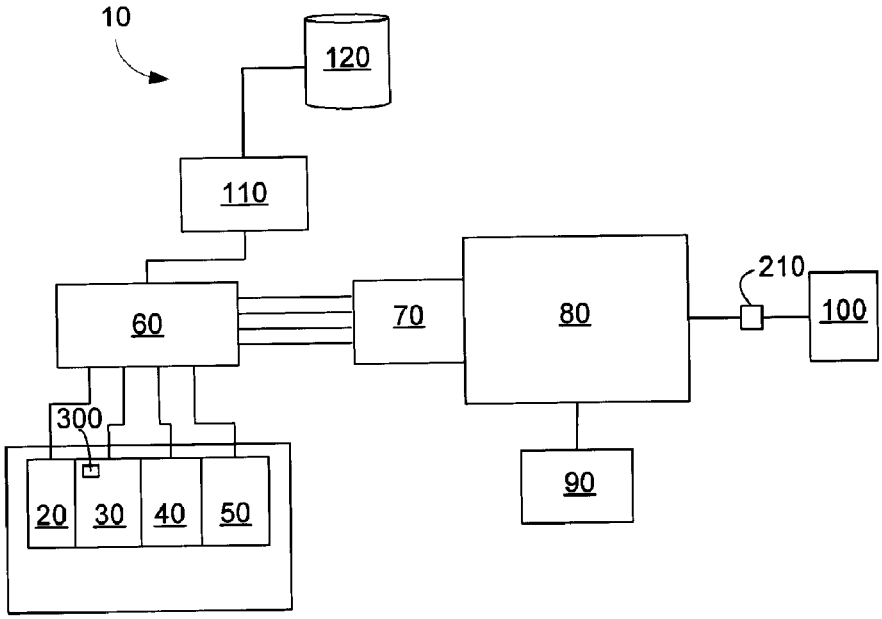
FIG. 1 is a block diagram schematically illustrating an example of a frozen beverage machine that may be used with the invention as is described herein.

Referring now to the drawings in which like numbers refer to like elements throughout the several views, FIG. 1 shows an example of a beverage dispenser system 10 that may be used with the sanitation method as is described herein. The beverage dispenser system 10 may be a frozen beverage dispenser. Although a frozen beverage dispenser is shown, almost any type of dispensing system may be used herein. Suitable frozen beverage dispensers are show in, for example, commonly owned U.S. Pat. No. 6,604,654, entitled "THREE-BARREL FROZEN PRODUCT DISPENSER", incorporated herein by reference. Another example is shown in U.S. Pat. No. 6,625,993, entitled "FROZEN BEVERAGE MACHINE AND METHOD OF OPERATION", also incorporated herein by reference. This reference also describes a "clean in place" system, i.e., an automatic, time based, sanitation cycle.

Similar to that described in U.S. Pat. No. 6,625,993, the beverage dispenser 10 may include a source of water 20; a source of syrup 30 (or other types of concentrate or additives); a source of gas 40, such as a source of compressed carbon dioxide; and a source of cleaning solution 50, such as sanitizer and/or detergent. A process flow block 60 may control the flow of these fluids. The combination of water, syrup, and gas from the sources 20, 30, 40 may be mixed as appropriate within a mixing block 70 and then frozen in a freezing chamber 80. The freezing chamber 80 may be in communication with a conventional refrigeration system 90. Once sufficiently mixed or frozen, a beverage may be dispensed via a nozzle 100.

A controller 110 may govern operation of the beverage dispenser 10 as a whole. The controller 110 may be a conventional microprocessing device capable of executing software commands. The controller 110 may include an internal clock or the controller 110 may be in communication with any other type of time system. A data file 120 may be accessible by the controller 110. The data file 120 may be any type of data storage system. The controller 110 and/or the data file 120 may be local or remote.

As described above, with known "clean in place" system, the sanitation cycle may begin upon the controller 110 determining that the predetermined time interval since the previous cleaning has occurred. Likewise, the controller 110 may start the sanitation cycle due to certain other events, such as a loss of power. Generally described, the sanitation cycle may include the steps of defrost, clean, rinse, sanitize, dispense, and refill. Other types of sanitation methods may be used herein. The sanitation cycle may include pumping the cleaning fluid through the beverage dispenser 10 as a whole.

Figure 2:
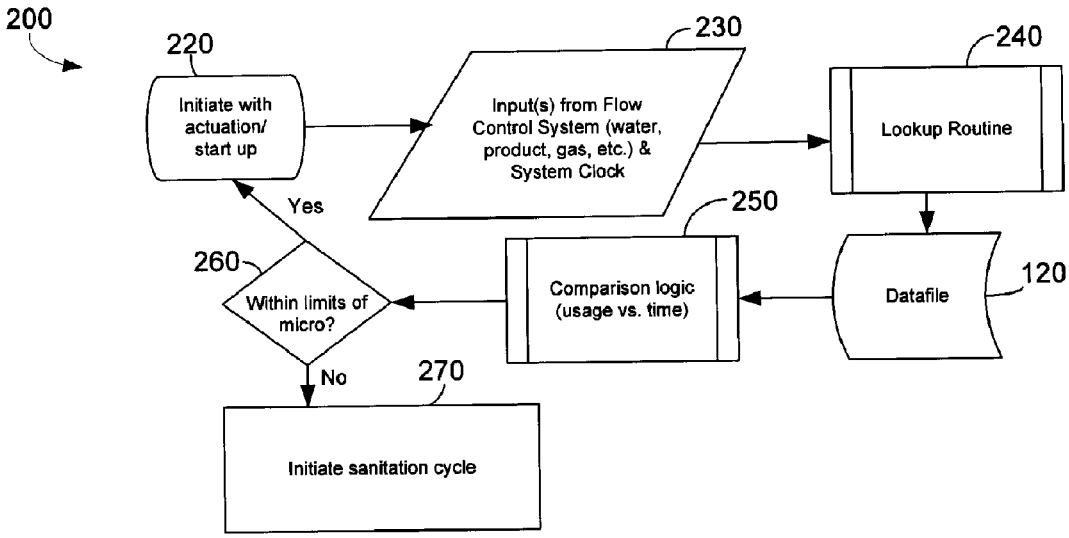
FIG. 2 is a block diagram showing an example of the process methodology as is described herein.

FIG. 2 shows a flowchart of an example of the sanitation method 200 as is described herein. The sanitation method 200 may be executed by conventional software code running on the controller 110 in association with the data file 120 or other source of memory means. Remote control means also may be used herein.

To the extent not present in the beverage dispenser system 10, one or more flow meters 210 may be positioned therein. The flow meter 210 may be positioned in any convenient location within the system 10 as a whole such as between the sources 20, 30, 40 and the process flow block 60, between the freezing barrel 80 and the nozzle 100, or in any other convenient location. The flow meter 210 may be a conventional paddlewheel or a similar type of measuring or counting device. Any other type of flow or velocity measuring device may be used, such as laser velocimeters, ultrasound, and similar devices. The flow rate may be measured directly or indirect methods also may be used. The term "flow meter" is intended to refer to any such measurement device.

The sanitation method 200 may begin at step 220 with the startup of the beverage dispenser system 10 as a whole. At step 230, the controller 110 receives input from the flow meter 210 as to the flows from the water, syrup, and/or gas sources 20, 30, 40; the nozzle 100; and/or from other locations within the system 10 as a whole. At step 240, the controller 110 looks up the relevant parameters in the data file 120 for a given product and/or time. At step 250, the controller 110 compares the flow data from the input step 230 with the parameters found in the data file 120 in the lookup routine of step 240. Specifically, the flow rate through the system 10 as a whole is compared to the predetermined time parameters. Based upon this comparison at step 250, a decision is made at step 260 as to whether the flow rates or the given time intervals require the initiation of a sanitation cycle. If not, the routine returns to the input step 230. If so, the controller 110 initiates a sanitation cycle at step 270.

The data file 120 may contain the conventional data as to the time intervals between normal sanitation cycles based upon the laboratory analysis for a given product. As described above, these cycle intervals are time based and factor in additional safety concerns. For example, laboratory testing may indicate that the dispenser 10 can run for thirty-five (35) days under minimal draw rates for a given product and stay within standards.

Should the dispenser 10 experience higher draw rates more in line with real sales, however, the sanitation cycle could be lengthened. For example, if a daily or weekly flow rate exceeds a baseline figure, then the cycle may be extended for a predetermined number of days. This longer period could range, for example for about sixty (60) to about ninety (90) days depending upon the nature of the product. Lengthening the cycles would waste less product, sanitizer, and mechanical component lifetime without jeopardizing safety.

The data file 220 also may have a "not to exceed" date. In other words, the controller 110 may start the sanitation cycle after a given number of days regardless of the flow rate therethrough.

The method 200 also may accommodate unscheduled stops in a more economical fashion. For example, if a power loss occurred two days ago and a sanitation cycle was preformed but the next sanitation cycle is due today, the controller 110 will recognize that the sanitation cycle is to be measured from the last event as opposed to starting a new cycle today.

The controller 110 may be able to determine the nature of the source of the syrup 30 based upon user input or the system 10 may be able to sense the nature of the product via a RFID (radio frequency identification) tag 300 or similar types of identification means. Based upon the nature of the syrup or other source, the controller 110 may access a different file in the data file 120. As a result, the system 10 as a whole can accommodate the use of different types of syrup sources 30 or other types of input. Further, the RFID tag 300 and the nature of the syrup also may effect the dispensing ratio and other product parameters of the system 10 as a whole.

It should be understood that the foregoing relates only to the preferred embodiments as are described herein and that numerous changes and modifications may be made herein without departing from the general spirit and scope of the invention as described by the following claims and the equivalents thereof.

What is claimed is:

1. A method of altering an initiation time of an apparatus sanitation cycle based upon a base line flow rate, comprising:

determining an actual flow rate through the apparatus;

comparing the actual flow rate to the base line flow rate; and delaying the initiation time of the apparatus sanitation cycle if the actual flow rate exceeds the base line flow rate.

2. The method of claim 1, wherein the delaying step comprises delaying the initiation time of the apparatus sanitation cycle if the actual flow rate exceeds the base line flow rate by a predetermined volume over a predetermined amount of time.

3. The method of claim 1, further comprising initiating the apparatus sanitation cycle at a predetermined time if the actual flow rate does not exceed the base line flow rate.

4. The method of claim 3, wherein the delaying step comprises initiating the apparatus sanitation cycle at a predetermined time if the actual flow rate does not exceed the base line flow rate by a predetermined volume over a predetermined amount of time.

5. The method of claim 1, wherein the apparatus sanitation cycle comprises one or more of the following: defrosting the apparatus, cleaning the apparatus, rinsing the apparatus, sanitizing the apparatus, and refilling the apparatus.

6. The method of claim 1, wherein the comparing step comprises determining a type of product loaded in the apparatus.

7. The method of claim 6, wherein the comparing step comprises looking up data on the type of product.

8. The method of claim 1, further comprising initiating the apparatus sanitation cycle if a not to exceed date is reached.

9. A method of activating an apparatus sanitation cycle, comprising:

determining an actual flow rate through the apparatus over a predetermined period;

comparing the actual flow rate to a base line flow rate over the predetermined period for a given product; and activating the sanitation cycle if the actual flow rate is less than the base line flow rate.

10. The method of claim 1 further comprising initiating an immediate apparatus sanitation cycle in response to a loss of power.

11. The method of claim 1, wherein the actual flow rate comprises one or more of the following: a water flow rate, a syrup flow rate, and a gas flow rate.

12. The method of claim 1, wherein the actual flow rate is associated with an aggregate volume of product dispensed by the apparatus over a period of time.

13. The method of claim 12, wherein the baseline flow rate is associated with an expected volume of product to be dispensed by the apparatus over the period of time.

14. The method of claim 12, wherein the period of time is measured in days.

15. The method of claim 6, further comprising varying the baseline flow rate in response to the type of product loaded in the apparatus.

16. The method of claim 6, wherein determining a type of product loaded in the apparatus comprises reading an RFID tag associated with the product.

17. The method of claim 1, wherein determining an actual flow rate through the apparatus comprises determining an aggregate volume of beverage dispensed by the beverage dispenser system over a predetermined number of days.

* * * * *